US008528702B2

(12) United States Patent
Maury

(10) Patent No.: US 8,528,702 B2
(45) Date of Patent: Sep. 10, 2013

(54) LIFT CAGE AND METHOD FOR THE INSTALLATION OF A LIFT

(75) Inventor: Julien Maury, Emmenbrücke (CH)

(73) Assignee: Inventio AG, Hergiswil (CH)

( * ) Notice: Subject to any disclaimer, the term of this patent is extended or adjusted under 35 U.S.C. 154(b) by 922 days.

(21) Appl. No.: 11/662,438

(22) PCT Filed: Aug. 19, 2005

(86) PCT No.: PCT/CH2005/000482

§ 371 (c)(1),
(2), (4) Date: May 27, 2008

(87) PCT Pub. No.: WO2006/026872

PCT Pub. Date: Mar. 16, 2006

(65) Prior Publication Data

US 2009/0057070 A1 Mar. 5, 2009

(30) Foreign Application Priority Data

Sep. 9, 2004 (EP) ..... 04405559

(51) Int. Cl.

| | |
|---|---|
| ***B66B 11/02*** | (2006.01) |
| ***B66B 11/08*** | (2006.01) |
| ***B66B 7/04*** | (2006.01) |
| ***B66B 5/16*** | (2006.01) |
| *B66B 5/04* | (2006.01) |

(52) U.S. Cl.

USPC ..... 187/401; 187/266; 187/302; 187/351; 187/409

(58) Field of Classification Search

USPC ..... 187/401
IPC ..... B66B 11/02
See application file for complete search history.

(56) References Cited

U.S. PATENT DOCUMENTS

| | | | | |
|---|---|---|---|---|
| 4,357,993 | A * | 11/1982 | Halpern et al. | 187/401 |
| 4,896,747 | A * | 1/1990 | Inglis | 187/413 |
| 5,564,529 | A * | 10/1996 | Ericson et al. | 187/401 |
| 2004/0195049 | A1 * | 10/2004 | Stobo et al. | 187/401 |
| 2006/0175148 | A1 * | 8/2006 | Starace | 187/401 |

FOREIGN PATENT DOCUMENTS

| | | | |
|---|---|---|---|
| DE | 2453196 | A * | 5/1976 |
| DE | 3134764 | | 8/1982 |
| EP | 1 364 905 | | 11/2003 |
| FR | 1.371.974 | | 9/1964 |
| FR | 2795060 | A1 * | 12/2000 |
| JP | 52047246 | A * | 4/1977 |
| JP | 2004262602 | A * | 9/2004 |
| JP | 2004359368 | A * | 12/2004 |
| JP | 2005041598 | A * | 2/2005 |
| WO | WO 03045829 | A1 * | 6/2003 |

* cited by examiner

*Primary Examiner* — William A Rivera
*Assistant Examiner* — Stefan Kruer
(74) *Attorney, Agent, or Firm* — Wolff & Samson, PC

(57) ABSTRACT

A lift cage includes a platform having a plurality of platform sections. The cage includes a front-sided and a rear-sided platform section arranged on a central platform section. The platform sections have connection points which are arranged on parallel, vertical planes, whereon the platform sections can be connected together by connection elements. In order to provide additional stabilization for the cage platform, stable platform edge profiles are connected to the uppersides of all platform sections. Subsystems of the lift cage can be pre-mounted in the platform sections. A method for installing a lift wherein a cage platform is prepared in at least two separate platform sections, and the platform sections of the cage platform, which are delivered separately, are connected together by connection elements during installation.

14 Claims, 3 Drawing Sheets

LIFT CAGE AND METHOD FOR THE INSTALLATION OF A LIFT

This is a U.S. national stage of application No. PCT/CH2005/000482, filed on Aug. 19, 2005. Priority is claimed on that application and on the following application:

Country: Europe, Application No.: EP 04405559.8, Filed: Sep. 9, 2004.

BACKGROUND OF THE INVENTION

The objects of the invention are an elevator car with a car-platform and a method of installing an elevator which includes an elevator car according to the invention.

A car-platform forms the basic supporting structure of an elevator car. Its usable surface supports the passengers or objects to be transported and is related in a certain manner to the load in the car for which the elevator car is designed. In addition, a car-platform can assume various other functions as, for example, the accommodation of subsystems for controlling the movement of the elevator car, the accommodation of door guides, or the accommodation of components of the elevator control system.

From DE 31 34 764 a platform for an elevator car is known which is made from at least two platform-sections of steel sheet, these platform-sections being fastened to each other by welding. Cited as advantages of this method of construction are ease of manufacture and a reduction in weight by comparison with car floors made from rolled sections.

A car-platform manufactured according to the approach of DE 31 34 764 has several disadvantages. Proposed is a symmetrical car-platform construction of two platform-sections each of the same type. Through the platform-sections being of the same type, their suitability for assuming different functions at different points of the elevator car is greatly restricted.

Furthermore, the platform-sections are fastened to each other in fixed manner so that after the manufacturing process the car-platform forms a relatively large unit. It is correspondingly difficult to transport the car-platform inside a building, to maneuver it through narrow places and to pass it through hoistway openings into the elevator hoistway.

SUMMARY OF THE INVENTION

The purpose of the present invention is firstly to create an elevator car whose car-platform is also manufactured from several platform-sections but which can assume different functions at different positions of the elevator car. The second purpose is to define on the basis of the elevator car according to the invention an efficient method of installing an elevator in which the said problems of transportation do not arise.

The first-mentioned purpose is fulfilled according to the invention in that the elevator car contains a car-platform in which on a central platform-section a front and a back platform-section are arranged.

An elevator car according to the invention has the advantage that the car-platform does not consist of platform-sections of the same type which are permanently fastened to each other but is constructed of platform-sections which have different forms so as to fulfill different functions which are present in an elevator car or simplify their realization.

The second aforesaid purpose is fulfilled by a method according to the invention in which, when a car-platform is shipped from the factory, one central and one front and one back platform can be made ready separate from each other and in which, on installation at the installation site of the elevator, the platform-sections of the car-platform which are separate from each other are fastened together by means of fastening elements.

Advantages of this method result especially when transporting the car-platform to the installation site and when conveying it to its installation position, for example in an elevator hoistway of a building.

For transportation, the platform-sections which are shipped separated from each other can be more easily packed and occupy less transportation space. They can also be loaded and unloaded by the transport personnel without special aids, conveyed inside a building, and passed through hoistway openings into an elevator hoistway, since they weigh less and are less bulky than a complete car-platform. For installation at the installation-site of the elevator the platform-sections can with simple aids be brought into installation position and there fastened together into a car-platform without great effort.

Advantageous embodiments and further developments of the invention are described below.

According to a preferred embodiment of the invention, the central platform-section of the car-platform takes the form of a safety-plank of the elevator car, there being mounted in or on this safety-plank several subsystems which serve the function of causing and/or controlling movement of the elevator car. It is preferable for these subsystems to be suspension-and-return pulleys via which a flexible means of suspension in the form of a car underslinging bears and drives the elevator car, to be car guide shoes with which the lower part of the elevator car is guided on guiderails, to be safety-gear which brake the elevator car in emergency, and to be a safety-space securing device to ensure a safety-space above the elevator car. The concept of the car-platform comprising several platform-sections enables the central platform-section to be equipped at the factory with the aforesaid subsystems independent of the other sections, which contributes substantially to improvement of the installation quality and reduction of the installation outlay at the installation-site of the elevator.

According to a further preferred embodiment of the invention, the front platform-section and the back platform-section have different forms so as to be able to fulfill different functions. A platform-section assigned to a door-front can, for example, fulfill the function of accommodating in a recess a door-sill, or having connecting elements for fastening a shear-apron under the door-sill. A back platform-section can, for example, by means of built-in elements fulfill the functions of enabling the connection between the car-platform and the car back-wall or of accommodating and fastening connection-boxes for the electrical installations of the elevator-car.

Important advantages derive from an embodiment of the invention in which at least two of the platform-sections of the car-platform have fastening points arranged in parallel vertical planes at which these platform-sections are joined to each other with fastening elements, preferably with screwed fasteners. In this embodiment, the platform-sections are aligned relative to each other of their own accord when the fastening elements are tightened. Furthermore, with this arrangement of the fastening points, as a result of the stresses arising from operation of the elevator the fastening elements are subjected mainly to tension and less to shear, as a result of which movement of the platform-sections relative to each other under load is reliably prevented.

According to a weight- and cost-saving embodiment of the invention, mounted over both side-edges of the car-platform are platform-edge sections which extend over, and are connected by connecting elements to, the upper surfaces of the platform-sections which are flanged to each other, the platform-edge sections being so dimensioned that they contribute substantially to the rigidity, and lifting capacity, of the car-platform. It is advantageous for their material and cross-section to be so chosen that together, and without the involvement of other components, they can absorb the bending stress which the load in the car exerts on the platform-sections 3, 4 extending from the central platform-section 2, and thereby undergo flexure of less than 1% of the length of the platform-sections. It is preferable for these properties of the platform-edge sections to be achieved through their being manufactured from steel or an aluminum alloy and their having a cross-section which relative to its horizontal axis of gravity has a geometric moment of inertia of at least 50 $cm^4$ and/or an overall height of at least 6 cm. Thanks to the stiffening of the car-platform by the platform-edge sections which are needed anyway as connecting element between the car-platform and the car side walls, the platform-sections can be executed with simple shapes, least-possible manufacturing outlay, and minimal weight.

According to a further advantageous embodiment of the invention, the platform-edge sections serving as stiffening elements also form connecting elements with which the side walls of the elevator car are connected to the car-platform.

This solution enables a rigid connection between the side walls of the elevator car and the car-platform, the combination of the two functions of the platform-edge sections resulting in substantial simplification of the construction of the car-platform and thereby considerable cost-savings.

Outstanding flexibility with regard to the manufacture of car-platforms according to the invention is achieved through it being possible for the front and/or back platform-section to be executed as a single-part platform-section or to comprise several sub-sections.

Particularly inexpensive car-platforms result if the sub-sections of the car-platform are executed as U-shaped bent-metal sections, each of which comprises one single piece of sheet metal.

According to an economically particularly attractive embodiment of the method according to the invention of installing an elevator, mounted at the factory on or in the platform-section constructed as safety-plank are subsystems of the elevator car which serve to cause or control movement of the elevator car (suspension-means pulleys, guide shoes, etc.). With the method according to the invention, this can be realized particularly advantageously since it does not cause the separate platform-sections to become excessively heavy. Pre-installation of the subsystems at the factory contributes substantially to improvement of the installation quality and reduction of the installation outlay at the installation-site of the elevator.

An operation 'at the factory' is understood to mean some manufacturing or assembly operation which takes place under factory-like conditions before shipment of the elevator and before its assembly at the installation site of the elevator, i.e. for example in a suitable building and using especially suitable aids and equipment.

According to a further embodiment of the method according to the invention, the front platform-section (3, 23) and the back platform-section (4, 24) are differently formed so that they can fulfill different functions.

A particularly cost-saving embodiment of the method is that the car-platform is manufactured according to a modular dimension concept in which the lengths of the front and back platform-sections as well as their widths are selected from a number of dimensions which are defined in the modular dimension concept.

Additional cost-savings are provided by a further development of the method in which the longitudinal supports which define the lengths of the respective platform-section, and the lateral supports which define the width of the platform-sections, are manufactured independent of each other and held in stock, preassembly at the factory of the platform-sections taking place only on the basis of a concrete order with defined car dimensions by combining prefabricated longitudinal and lateral supports with corresponding dimensions.

According to a particularly advantageous embodiment of the method according to the invention, before assembly at the installation-site of the elevator the platform-sections of the car-platform packed individually and/or in separated state are transported to the installation-site.

By this means, general handling of the car-platform is facilitated and the separated platform-sections can be transported to the installation-site with simpler or even no aids and in smaller vehicles.

Two exemplary embodiments of the invention are explained below by reference to the attached drawings.

BRIEF DESCRIPTION OF THE DRAWINGS

Shown are in

DETAILED DESCRIPTION OF THE INVENTION

Figure 1:
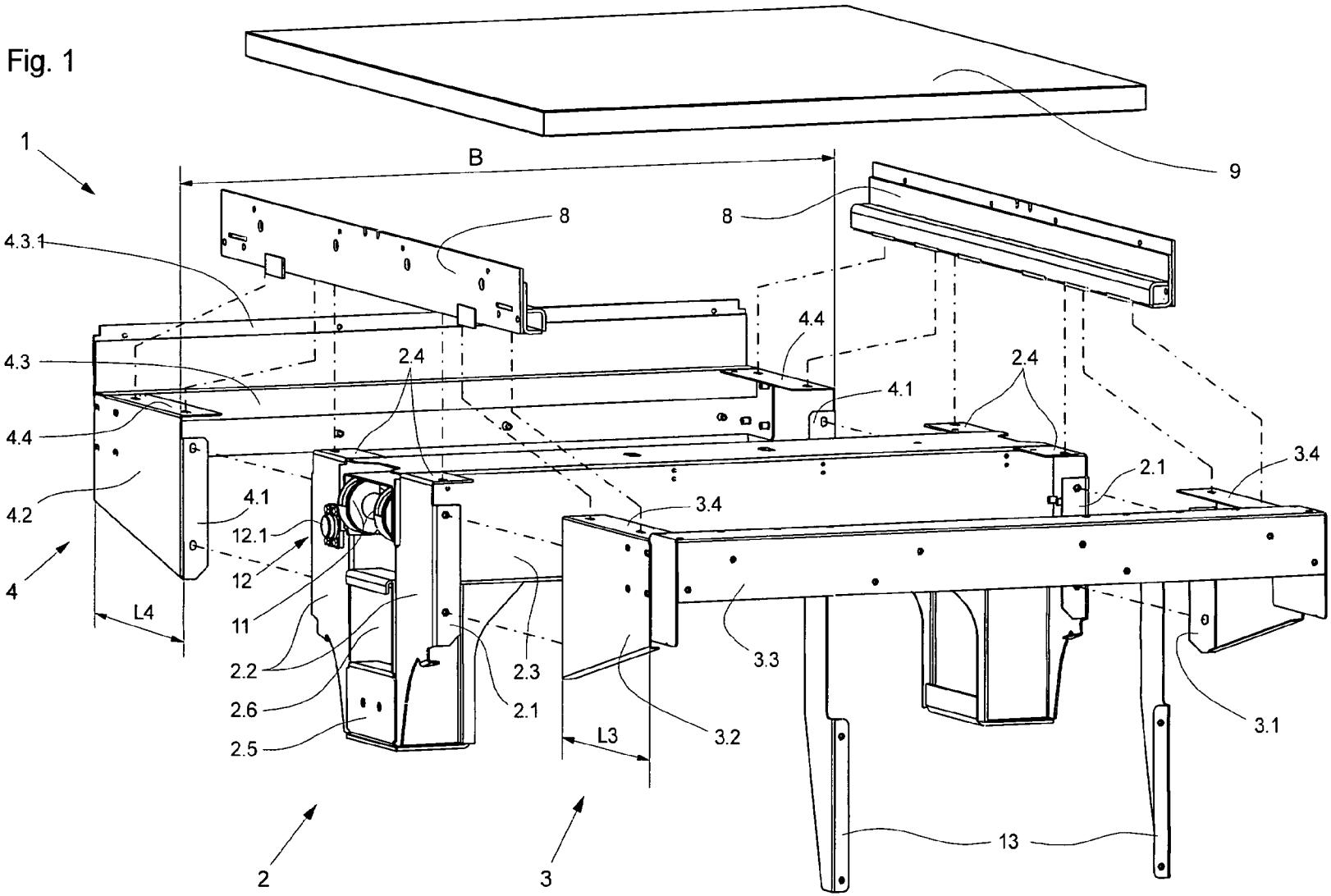
FIG. 1 an exploded-view drawing of a first embodiment of the car-platform of an elevator car according to the invention.

FIG. 1 shows in the form of an exploded-view drawing the structure with all significant component parts of a first embodiment of the car-platform 1 of an elevator car according to the invention.

Figure 2:
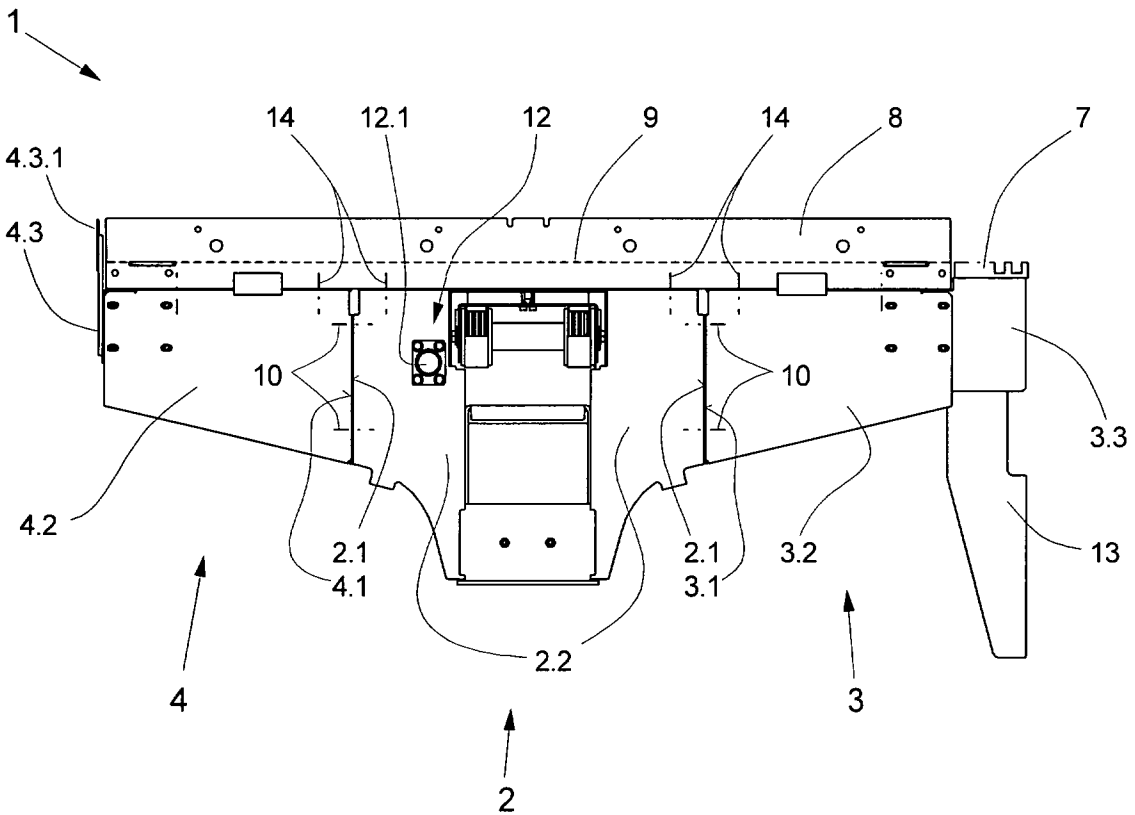
FIG. 2 a side view of the car-platform shown in exploded view in FIG. 1.

FIG. 2 shows in a side view the car-platform 1 according to FIG. 1 in assembled state.

The car-platform 1 comprises several platform-sections 2, 3, 4 which are made from steel sheet and steel plates, one front and one back platform-section 3, 4 respectively being arranged on a central platform-section 2. Fixed on the upper surfaces of the platform-sections, which lie in a common plane, is a car-floor plate 9 which is preferably executed as a laminated plate. Suitable as car-floor plate are preferably honeycomb sandwich plates of aluminum or plastics or wood-fiber boards with metallic laminates on both sides.

The central platform-section 2 takes the form of a safety-plank of the elevator car which is built into the car-platform. It provides the elevator car with the required rigidity, the space being saved which in normal elevator cars is occupied by a safety-plank present under, and not built into, the car-platform.

The central platform-section 2 forming a safety plank has, inter alia, fastening points 2.5, 2.6 for car guide shoes and/or safety gears. Safety buffers can also be attached to this safety plank. Furthermore, built into the central platform-section 2 forming the safety plank are suspension-and-return pulleys 11 via which a flexible suspension means bears and moves the elevator car. In the present case, the suspension-and-return pulleys 11 have grooves and ribs running in the direction of the circumference which act in conjunction with ribs and grooves of V-ribbed belts serving as suspension means.

In the central platform-section 2 forming the safety-plank, it is also possible for a safety-space protection device 12 to be built in. By laterally extending a bolting rod 12.1 which acts in conjunction with a stop fixed in the elevator hoistway, this ensures that, for example, on an inspection trip a safety distance between the car roof and the hoistway headroom, and/or between the car floor and the floor of the elevator hoistway, cannot be passed.

The platform-sections 2, 3, 4 have fastening points 2.1, 3.1, 4.1 lying in parallel vertical planes, at each of which two of the platform-sections are fastened together by means of fastening elements 10. It is preferable for releasable fastening elements, as for example screw fasteners, to be used. Fastening of the platform-sections, which only takes place on assembly at the installation site of the elevator, can, however, also be realized with non-releasable fastening elements as, for example, rivets.

In this fastening concept, when assembling the car-platform at the installation site of the elevator, the respective platform-sections to be joined are first roughly aligned with each other. Then, with the aid of the fastening elements, they are laid against each other in the area of the vertical fastening points, as a result of which the platform-sections align themselves with each other of their own accord. The precise mutual alignment is aided by the simultaneous mounting of platform-edge sections which is described below.

All of the platform-sections 2, 3, 4 each comprise at least two longitudinal supports 2.2, 3.2, 4.2 and at least one lateral support 2.3, 3.3, 4.3. The lateral support 2.3 is part of the central platform-section 2 which forms a safety plank of the elevator car which is built into the car-platform 1. The lateral support 3.3 serves as support for a door-sill section 7 (shown only in FIG. 2) as well as for supports 13 of a shear apron, and an upper part of the lateral support 4.3 is so constructed that a car back-wall (not shown) can be fastened to it.

Referenced with 8 are two platform-edge sections which on assembly of the elevator at the installation-site of the elevator are fastened at fastening points 2.4, 3.4, 4.4 of the platform-sections 2, 3, 4 to the latter and extend over the upper surfaces of all the platform-sections which are flanged to each other. The said fastening points on the platform-sections are so arranged that in the assembled state of the car-platform 1 they lie in the area of its side-edge and in a common horizontal plane. The platform-edge sections 8 are so dimensioned that they contribute substantially to the rigidity of the entire car-platform. It is advantageous for their material and cross-section to be so chosen that together, and without the involvement of other components, they can absorb the bending stress which the load in the car exerts on the platform-sections 3, 4 extending from the central platform-section 2, and thereby undergo flexure of less than 1% of the length of the respective platform-sections. It is preferable for this property of the platform-edge sections 8 to be achieved through their being manufactured from steel or an aluminum alloy and their having a cross-section which relative to its horizontal axis of gravity has a geometric moment of inertia of at least 50 cm.sup.4 and/or an overall height of at least 6 cm.

The platform-edge sections 8 serve firstly to stiffen the entire car-platform 1 so that the requirements for rigidity of the platform-sections 2, 3, 4 can be correspondingly reduced. These can therefore be produced with lower weight. In the present case, the platform-sections 3 and 4 are manufactured solely of steel sheet with a maximum thickness of 2.5 mm. Secondly, the platform-edge sections 8 serve to join the (not shown) side walls of the car to the car-platform 1 and thereby form an aesthetically pleasing transition element, visible from inside the car, between the car floor and the said side walls of the car.

During assembly at the installation site of the elevator, the platform-edge sections 8 also serve, with the aid of the fastening elements 14 in place between them and the platform-sections, to align the upper surfaces of the platform-sections 2, 3, 4, which are flanged to each other, accurately and flush with each other.

In and/or on the front and/or back platform-sections 3, 4, car components such as, for example, a door-sill section 7, a mounting 13 for a shear apron under the door-sill section 7, a mounting element 4.3.1 for the back-wall of the car, end-switches, terminal boxes for electrical systems, hoistway lighting lamps, etc. can be present. So that the front and/or back platform-sections 3, 4 can fulfill these functions, they have correspondingly different shapes.

The aforementioned components and subsystems (car guide shoes, safety gear, safety buffers, suspension-and-return pulleys, safety-space securing device, shear apron, end-switches, terminal boxes, lamps, etc.) which are built into, or onto, one of the platform-sections 2, 3, 4 are preferably pre-installed, and preferably wired, at the factory, so as to keep the outlay for assembly at the installation site of the elevator as low as possible and to optimize the quality of assembly. A car-platform according to the invention constructed of several platform-sections offers ideal conditions for this assembly concept since firstly, the individual platform-sections to be transported and brought into position for assembly are relatively easily manipulated even with built-in subsystems, and secondly, the still separate platform-sections can be better packed so that the said components and subsystems are adequately protected.

The longitudinal supports 3.2, 4.2 which define the lengths L3, L4 of the respective platform-sections 3, 4, and the lateral supports 2.3, 3.3, 4.3 which define the width B of the platform-sections 2, 3, 4, are manufactured independent of each other and held in stock, the lengths L3 and L4, as also the width B, of the platform-sections 2, 3, and 4 being selectable in accordance with a modular dimension concept. Preassembly at the factory of the platform-sections takes place only on the basis of a concrete order with defined car dimensions by combining longitudinal and lateral supports with corresponding dimensions.

With this manufacturing and stocking concept, the costs of producing and stocking the car-platforms can be kept extremely low while an optimal ability to supply remains assured.

Figure 3A:
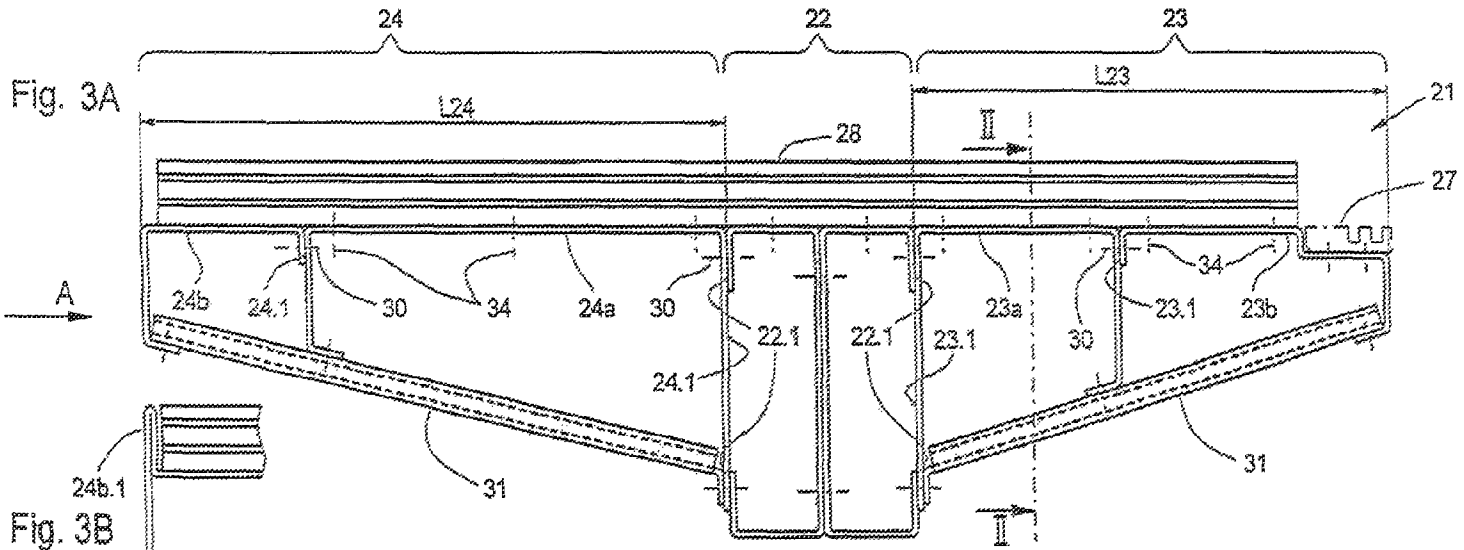
FIG. 3 a side view of a second embodiment of the car platform of an elevator car according to the invention.
Figure 3B:
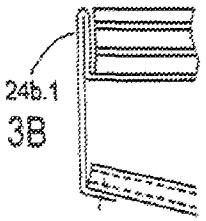
Figure 4B:
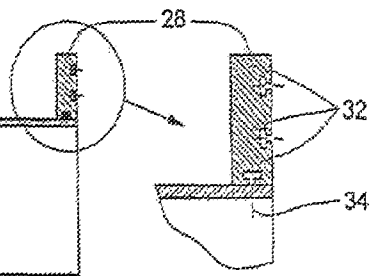
FIG. 4 a view of the car-platform according to FIG. 3 along its length and a cross section through the car-platform.
Figure 4A:
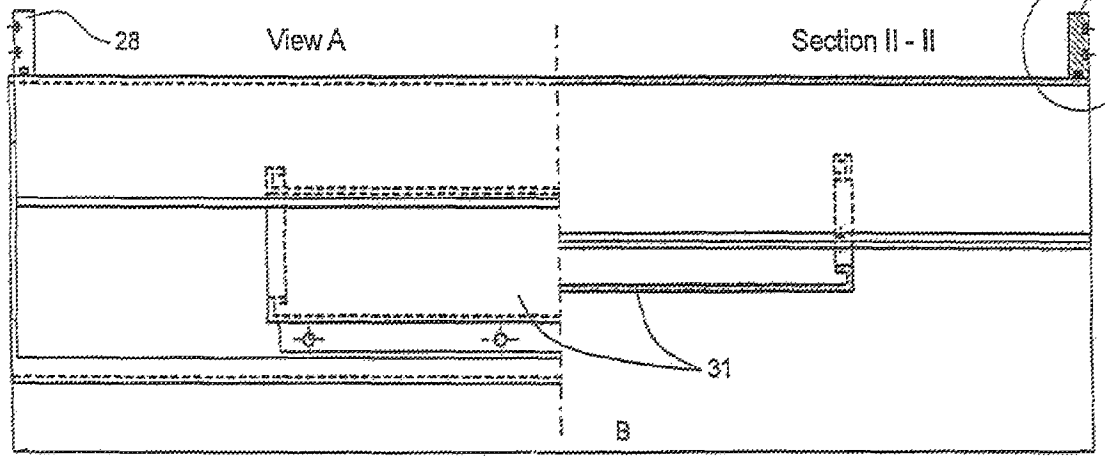

FIG. 3 shows a side view of a second embodiment of a car-platform 21 of the elevator car according to the invention. FIG. 4 shows a view of this car-platform 21 in its longitudinal direction A and a cross section through the car-platform at the interface indicated by II-II in FIG. 3.

This embodiment of a car-platform 21 according to the invention also comprises several platform-sections 22, 23, 24, one front and one back platform-section 23, 24 respectively being arranged on a central platform-section 22. The front and the back platform-sections 23, 24 are preferably constructed of several sub-sections 23*a*, 23*b*, 24*a*, 24*b*.

The sub-sections 23*a*, 23*b*, 24*a*, 24*b* of the front and back platform-sections 23, 24 are executed as essentially U-shaped bent-metal sections and in each case made by parallel bending from one single piece of sheet metal. The vertically arranged webs of the U-shaped bent-metal sections act not only as lateral stiffeners of the car-platform but also form fastening points 22.1, 23.1, 24.1 arranged in vertical planes at which the sub-sections are joined to each other by means of fastening elements 30, and which also serve as connecting points between the central platform-section 22 and the front and back platform-sections 23, 24 respectively. Front and back platform-sections of little length can also consist of only one single U-shaped bent-metal section.

As in the first embodiment, the central platform-section 22 is executed as a safety plank built into the car-platform 21 and made solely of steel sheet. This platform-section 22 also has fastening points for car guide shoes and safety gears, as does the safety plank shown in FIG. 1. However, these fastening points are not shown here so as not to detract from illustration of the particularly simple structure of the platform-sections.

The front and back platform-sections 23, 24 can be of different shapes so as to fulfill different functions and requirements, or to allow different positions of the central platform-section. They can, for example, be so formed (bent) that they can accept a door-sill section 27, or that a fastening element 24*b*.1 for fixing the back-wall of the car is built into their sheet-metal body. Different dimensions of the car-platform 21 are realized by modifying the lengths L 23, L 24 of the platform-sections 23, 24, or their sub-sections 23*a*, 23*b*, 24*a*, 24*b*, which are flanged to the central platform-section 22 (safety plank). Different widths B are achieved by using different widths of steel sheet for manufacturing the platform-sections 22, 23, 24, and 22, 23*a*, 23*b*, 24*a*, 24*b* respectively.

All the subsystems and components mentioned in association with the first embodiment can also be built into, or onto, the platform-sections 22, 23, 24 of this car-platform 21, building the subsystems into, or onto, the platform-sections which are separate from each other taking place as preassembly at the factory.

As mentioned above, in this embodiment the platform-sections 23, 24, or their sub-sections 23*a*, 23*b*, 24*a*, 24*b* flanged to the central platform-section 22, are each made from one single piece of sheet metal whose U-shaped form is produced by simple parallel bending. All the platform-sections and/or sub-sections have vertically oriented webs which run perpendicular to the car-platform 21 and give the car-platform in the perpendicular direction sufficient rigidity. So as to be able to additionally fix the free lower ends of the vertical webs, these can be joined to each other by means of, for example, an auxiliary section 31. Mounting of this auxiliary section 31 only takes place at the installation site of the elevator.

As is readily apparent from FIG. 3, the platform-sections, which are constructed of sections made from relatively thin sheet metal bent crosswise, do not offer sufficient bending rigidity for a car-platform in its longitudinal direction. Hence, also in the embodiment of a car-platform 21 described here, the rigidity in longitudinal direction required for elevator operation is assured by mounting at the installation site two sufficiently rigid platform-edge sections 28 with which the upper surfaces, lying in a common plane, of all the platform-sections 22, 23, 24 are connected.

In this embodiment also, the platform-edge sections 28 serve additionally as fastening element between the car side walls (not shown) and the car-platform 21. So as to be able to fasten the platform-edge sections 28, which here have a rectangular cross section, to both the platform-sections 22, 23, 24 and the side walls, the platform-edge sections 28 are provided along their entire length with several T-shaped grooves 32. When the car-platform 21 is assembled at the installation site, screw heads or nuts of suitable shape are inserted into these T-shaped grooves 32 and bolted to the platform-sections and side walls.

With the exception that in this second embodiment the platform-sections have no lateral supports, and that hence such lateral supports do not need to be separately manufactured and held in stock, all of the properties and advantages of the car-platform associated with the first embodiment, as well as the characteristics and advantages of the method of installing an elevator, also apply to the second embodiment described here.

The invention claimed is:

1. An elevator car comprising:

a car-platform having a car-floor plate and several platform-sections including a front platform-section and a back platform-section arranged on a central platform-section, wherein the central platform-section of the car-platform is constructed as a safety-plank of the elevator car and upper surfaces of the front platform-section, the back platform-section, and the central platform-section are configured to lie in a common plane and receive the car-floor plate; and platform-edge sections mounted over two side-edges of the car-platform, which platform-edge sections extend over, and are fastened by fastening means to, upper surfaces of all the platform-sections, wherein mounted on or in the central platform-section constructed as a safety-plank is a safety gear, and wherein the platform-edge sections have a cross section and are of a material such that the edge sections can absorb bending stress which a load in the car exerts on the platform-sections extending beyond the central platform-section and thereby undergo a flexure of less than 1% of a length of the platform-sections, and the platform-edge sections are made of one of steel and an aluminum alloy and each have a cross section which, relative to a horizontal axis of gravity of a corresponding platform-edge section, has a geometric moment of inertia of at least 50 $cm^4$ and/or an overall height of at least 6 cm.

2. The elevator car according to claim 1, wherein at least one subsystem which serves to cause and/or control movement of the elevator car is mounted to and/or mounted in the safety plank.

3. The elevator car according to claim 2, wherein the at least one subsystem comprises at least one of the following:

suspension-and-return pulleys via which a flexible suspension means bears and drives the elevator car, car guide shoes, and a safety-space securing device to ensure a safety-space above the elevator car.

4. The elevator car according to claim 1, wherein the front and/or the back platform-section(s) is/are executed as single-part platform-sections or comprise(s) several sub-sections.

5. The elevator car according to claim 4, wherein the front and back platform-sections and/or the sub-sections of the car-platform are U-shaped sections which each consist of a single sheet of bent sheet metal.

6. The elevator car according to claim 1, wherein the front platform-section and the back platform-section are differently formed so as to be able to fulfill different functions.

7. The elevator car according to claim 1, wherein at least two of the platform-sections have fastening points arranged in parallel vertical planes at which the platform-sections are fastened to each other by fastening elements.

8. The elevator car according to claim 1, wherein the platform-edge sections form fastening elements for fastening side walls of the elevator car to the car-platform.

9. A method of installing an elevator comprising an elevator car with a car-platform made from several platform-sections, the method comprising the steps of:

receiving a car-platform, comprising a car-floor plate, central platform-section, front platform-section, and a back platform-section, from a factory so that in each case one central and one front and one back platform-section respectively can be made ready separate from each other; and assembling the platform-sections and car-floor plate of the car-platform which are separate from each other at an installation-site of the elevator by fastening together the sections with fastening elements, fastening platform-edge sections mounted over two side-edges of the car-platform, which platform-edge sections extend over, by fastening means to upper surfaces of all the platform-sections, wherein mounted on or in the central platform-section is a safety gear, wherein the central platform-section is constructed as a safety-plank of the elevator car, and upper surfaces of the front platform-section, the back platform-section, and the central platform-section are configured to lie in a common plane and receive the car-floor plate, and wherein the platform-edge sections have a cross section and are of a material such that the edge sections can absorb bending stress which a load in the car exerts on the platform-sections extending beyond the central platform-section and thereby undergo a flexure of less than 1% of a length of the platform-sections, and the platform-edge sections are made of one of steel and an aluminum alloy and each have a cross section which, relative to a horizontal axis of gravity of a corresponding platform-edge section, has a geometric moment of inertia of at least 50 $cm^4$ and/or an overall height of at least 6 cm.

10. The method according to claim 9, and further comprising mounting, at the factory, on or in the central platform at least one of the following subsystems of the elevator car:

suspension-and-return pulleys via which a flexible suspension means bears and drives the elevator car, car guide shoes, and a safety-space securing device to ensure a safety-space above the elevator car.

11. The method according to claim 9, wherein the front platform-section and the back platform-section are differently formed so as to fulfill different functions.

12. The method according to claim 9, including additionally joining the platform-sections of the car-platform to each other at fastening points arranged in parallel vertical planes.

13. The method according to claim 9, wherein the car-platform is manufactured according to a modular dimension concept in which lengths and widths of the front and back platform-sections are selected from a number of dimensions which are defined in the modular dimension concept.

14. The method according to claim 9, including transporting the platform-sections of the car-platform to the installation-site as individual packages and/or in separated states, prior to assembly of the elevator at the installation-site.

* * * * *